US006024205A

United States Patent [19]

Adalbert

[11] Patent Number: 6,024,205

[45] Date of Patent: Feb. 15, 2000

[54] PROCESS AND DEVICE TO POSITION EMPTY TUBES ON A TUBE CONVEYING DEVICE

[75] Inventor: Stephan Adalbert, Beilngries-Paulushofen, Germany

[73] Assignee: Rieter Ingolstadt Spinnereimaschinenbau AG, Ingolstadt, Germany

[21] Appl. No.: 08/910,630

[22] Filed: Aug. 13, 1997

[30] Foreign Application Priority Data

Sep. 24, 1996 [DE] Germany ..... 196 39 155

[51] Int. Cl.[7] ..... B65G 37/00

[52] U.S. Cl. ..... 198/463.6; 198/345.1; 198/459.6

[58] Field of Search ..... 198/345.1, 367.1, 198/368, 419.1, 459.6, 459.7, 463.4, 463.6, 536, 531

[56] References Cited

U.S. PATENT DOCUMENTS

| | | | |
|---|---|---|---|
| 2,824,484 | 2/1958 | Thompson | 198/463.6 X |
| 3,826,348 | 7/1974 | Preisig et al. | 198/419.1 X |
| 4,899,866 | 2/1990 | Colamussi | 198/463.6 X |

FOREIGN PATENT DOCUMENTS

| | | |
|---|---|---|
| 3715130A1 | 11/1988 | Germany . |
| 3823488A1 | 3/1989 | Germany . |
| 383197A1 | 5/1989 | Germany . |
| 19529566A1 | 2/1996 | Germany . |
| 2201168 | 8/1988 | United Kingdom . |
| 2209349 | 5/1989 | United Kingdom . |

OTHER PUBLICATIONS

German Search Report, Jan. 7, 1997.
EPO Search Report, Oct. 2, 1997.

*Primary Examiner*—James R. Bidwell
*Attorney, Agent, or Firm*—Dority & Manning

[57] ABSTRACT

The present invention relates to a process for positioning of empty tubes (2) on a tube conveying device (12) across from a grasping device (30), which is installed in particular on a service unit (3) capable of traveling alongside a plurality of adjoining spinning stations (10). The empty tube (2) conveyed by the tube conveying device (12) is stopped by a stop (4) in a defined position at the work station (10) where the empty tube (2) is needed. At the same time, a tilting moment in the direction of the tube conveying device (12) is exerted upon the empty tube (2) while it is braked. The tilting moment is applied to the empty tube (2) at its leading end (24) and is increased during braking of the empty tube. To carry out the process, a stop (4) can be moved on the service unit (3) into the conveying path of the empty tube conveyed by the tube conveying device (12), the stop (4) being associated with a tilting moment in the direction of the tube conveying device (12). The tube conveying device (40, 40*a*, 70, 70*a*) may be made as an integral part of the stop (4).

30 Claims, 5 Drawing Sheets

PROCESS AND DEVICE TO POSITION EMPTY TUBES ON A TUBE CONVEYING DEVICE

BACKGROUND OF THE INVENTION

The present invention relates to a process to position empty tubes on a tube conveying device relative to a grasping device, as well as to a device to carry out this process.

In a known process (DE 195 29 566 A1) a stop is moved into the conveying path of the empty tube to be stopped so that the empty tube runs up against this stop and is thus stopped, even if the tube conveying device continues to run. In order to orientate the empty tube precisely relative to the operating station, e.g. of a winding or spinning station to which the empty tube is to be conveyed, a second stop is moved against the trailing end of the conveyed empty tube, whereby the conical configuration of the stops or the suitable presentation orientations of the stops relative to the empty tube causes the empty tube to be held between the two stops so that it thereby assumes the desired defined position relative to the operating station. It has been shown however that due to its inertia and possible imbalance or uneven distribution of mass, as e.g. with conical tubes, the empty tube tends to rear up on the tube conveying device due to the impact on the stop and to fall off laterally from same before it can be fixed in its position by the second stop, so that it cannot be grasped and conveyed to the spinning station. This may lead to malfunctions in the machine.

OBJECTS AND SUMMARY OF THE INVENTION

It is therefore a principal object of the present invention to create a process and a device which ensue that the empty tube does not leave the tube conveying device, even during braking and stopping. Additional objects and advantages of the invention will be set forth in part in the following description, or may be obvious from the invention, or may be learned through practice of the invention.

According to the invention, by producing a tilting moment in the direction of the tube conveying device, the tendency of the suddenly braked empty tube is counteracted so that they are stopped from standing up and jumping out laterally. In this manner, the empty tube which arrives before the work, winding or spinning station to be supplied, actually remains in the desired stopping position and can be conveyed to the wanted location. Undesirable loss of time in calling up and conveying new empty tubes is thus effectively avoided. In addition, malfunctions which may otherwise be produced by empty tubes falling off the tube conveying device are prevented. Picking up and cleaning away fallen empty tubes is also eliminated.

The process is further developed advantageously since it is ensured in this manner that the empty tube is secured by the generation of a tilt moment on the tube conveying device during the entire time during which a danger exists that the empty tube may leave the tube conveying device due to an unwanted, uncontrolled jumping movement.

It has proven to be advantageous for the process according to the invention since, due to the reduced impact speed of the empty tubes, the defined stopping position can be attained more reliably.

To ensure that the empty sleeve actually reaches its defined stopping position at a reduced delivery speed, it is advantageous for the empty tube to be decelerated from the braking of the tube conveying device to the reduced speed of the tube conveying device. This is achieved reliably according to the invention. Here, the tilting moment in the direction of the tube conveying device can be produced a second time also during the stopping of the empty tube when the latter has reached its desired defined stopping position.

In principle, the manner in which the tilting moment is produced is immaterial, but it has bee shown that in the interest of simplicity of design and construction, it is sufficient if this tilting moment and the resulting force with which the empty tube is pressed against the tube conveying device or conveyor is produced on the forward end of the empty tube to be braked and stopped.

To carry out the above-described process, the tube pressing device presses the empty tube which is to be stopped as a result of the tilting moment produced in such a manner against the tube conveying device that the empty tube is unable to leave this tube conveying device.

The sleeve pressing device may be of various configurations, but in the interest of material and space savings, the tube pressing device is made as an integrated part of the stop.

The device according to the invention is made in an especially simple and therefore advantageous design if the stop is provided on its side towards the empty tube with an impact surface which forms an acute angle with the leading face of the empty tube.

According to the invention, the stop for the empty tube can be adjustable in order to ensure a precise stopping position for the empty tube in spite of possible manufacturing tolerances.

In order to reduce the impact effect and thereby the tendency of the empty tube to leave the tube conveying device, the invention is advantageously developed further in that the stop has an attenuating device, whereby a simple solution from the standpoint of design is achieved by making the attenuating device in the form of an elastic or elastically supported holder.

If a stop is provided in each direction of movement of the tube conveying device relative to the service device, the empty tube can be pre-stopped by a monitoring device, whereby the precision of positioning the empty tube can be increased without interfering with the reliable function of the device. In this case a design of the device according to the invention associates the monitoring device with the stop.

Provisions are made for the empty tubes to reach the service unit with the stops depending on their position, once from one side, and one time from the other side, and thus the two known stops can be installed on an attenuating element in another advantageous embodiment of the device according to the invention. In this manner, a contact pressure relative to the presented empty tube is produced by generating a torque or tilting moment independently of the direction of arrival of the empty tube, always in the same manner and with the same means.

In addition to or instead of the design of the stop surface for the impacting empty tube in the form of a tube contacting device, this tube contacting device can also be brought in action upon the empty tube by a pneumatic cylinder. Here the design of a device according to the invention wherein the attenuating element can be moved into the conveying path of the tube is advantageous, since good space arrangements are provided in this manner.

In order to avoid having to calculate the point in time for the reduction in speed of the conveying speed of the tube conveying device, and so that it may be reliably coordinated with the correct position of the empty tube to be braked, the device according to the invention may be made wherein the tube conveying device can be moved in either longitudinal direction with two stops at a distance from each other which is essentially equal to the length of the empty tube.

Preferably a scanning device is assigned to each holder constituting a monitoring device to monitor its position, said scanning device being advantageously designed in form of a piezoelectric switching element.

The object of the invention is simple in handling and in design, and at the same time effective in its action. With little space and material requirements, the device according to the invention is furthermore more reliable in its operation. Thanks to its space-saving design, it can also be retrofitted without any difficulty at any time in already existing machines.

Examples of embodiments and further details are discussed in greater detail below with the help of drawings.

DETAILED DESCRIPTION OF THE INVENTION

Figure 1:
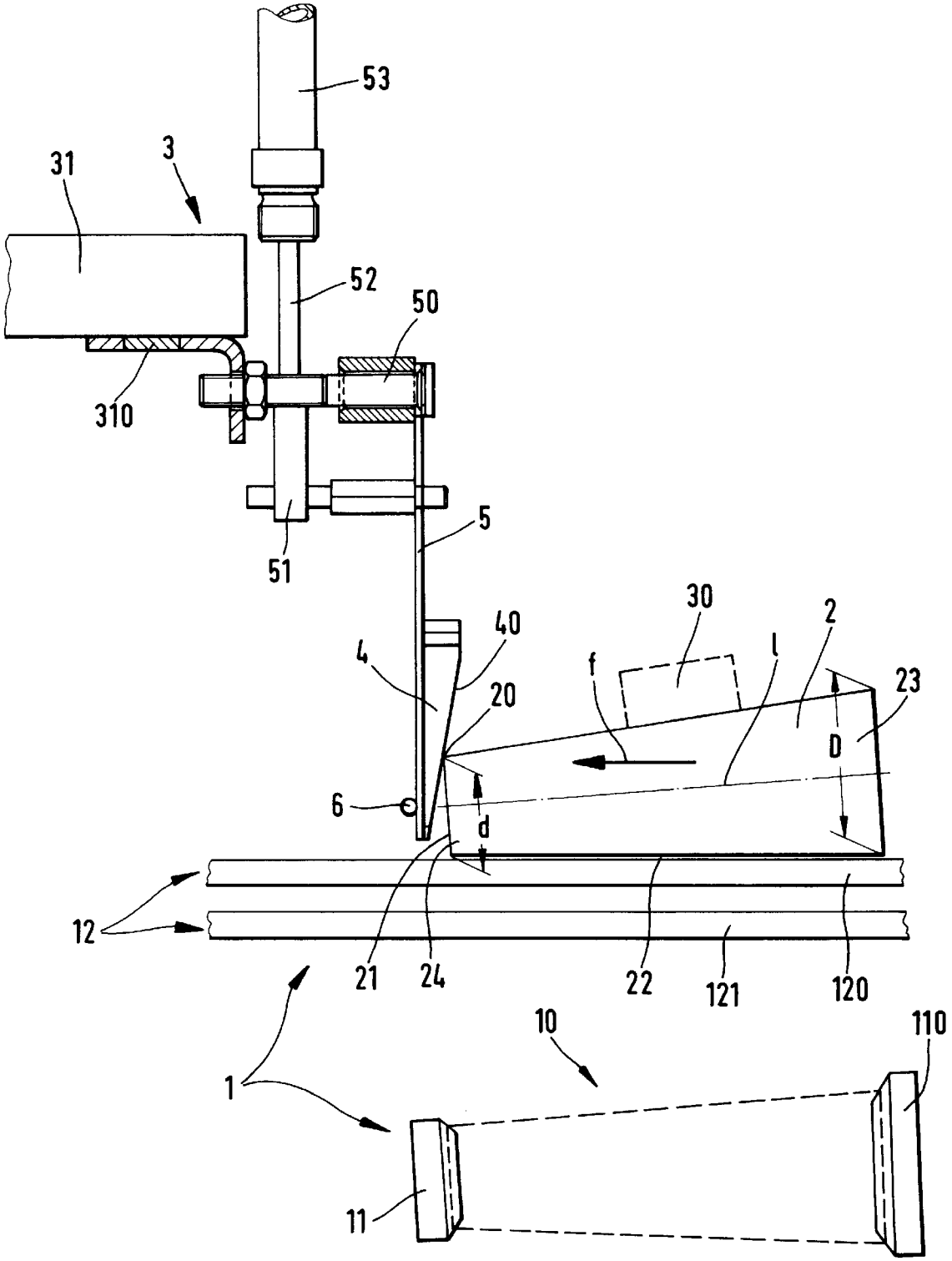
FIG. 1 shows a schematic front view of part of a tube conveying device as well as a tube contact pressure device according to the invention.

Reference will now be made in detail to the presently preferred embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a further embodiment.

FIG. 1 only shows those elements of a textile machine, here a spinning machine to the work or spinning stations 10 of which empty tubes 2 are conveyed in a precisely defined position, which are necessary in order to understand the invention. Each work station 10 is provided with two bobbin arms 11 and 110 between which the delivered empty tube 2 must be positioned (see broken lines) so that the yarn spun on it can then be wound up. For the conveying of the empty tubes 2 along a plurality of identical work or spinning stations 10 of the spinning machine 1, a tube conveying device is used, said tube conveying device comprising two parallel circulatory endless belts or bands 12 and 13 (see also FIG. 3) according to FIG. 1, on the upper trunks 120 and 130 of which the empty tubes 2 are resting, while the lower trunks 121 and 131 are the returning trunks of the endless belts or bands 12 and 13.

The two upper trunks 120 and 130 are guided and supported in a guide 140 and the two lower trunks 121 and 131 in a guide 141. The guides 140 and 141 are supported by means of holders 14 of the machine frame 15 of the spinning machine 1.

For a defined stopping of the empty tubes 2 at the work or spinning station 10 where it is needed, a service unit 3 capable of traveling alongside the work or spinning station 10 of the spinning machine 1 is used. It is possible to provide for the service unit 3 to be serving only one longitudinal side, or both longitudinal sides of the spinning machine 1.

The service unit 3 is equipped with a suitable grasping device 30 by means of which the empty tube 2 which is stopped across from the work or spinning station 10 is picked up in the usual manner and is moved between and transferred to the two bobbin arms 11 and 110 (see broken lines in FIG. 1).

The defined stopping of the empty tube 2 delivered by two bands 12 and 13 is effected by means of a stop 4 carried by the service unit 3, which can be swivelled down from a high rest position (see broken lines in FIG. 3) into its work position in which the it is situated in the conveying path of the empty tubes 2 being conveyed on the bands 12 and 13. For this purpose, the stop 4 is supported by means of a holder 5. The holder 5 in turn is mounted by means of an articulated bolt 50 which can be adjusted parallel to the conveying direction of the empty tube 2 on a part 310 of the frame 31 of the service unit 3. At a distance from this articulated bolt 50, the holder 5 is connected to a rod 51 which in turn constitutes the extension of a piston 52 of a pneumatic or hydraulic cylinder 53. The cylinder 53 is controlled in a known manner by means of a conventional control system which is therefore not shown in order to swivel the stop 4 as needed into the conveying path of the empty tube 2. Instead of the cylinder 53, it is also possible to use a motor.

Figure 2:
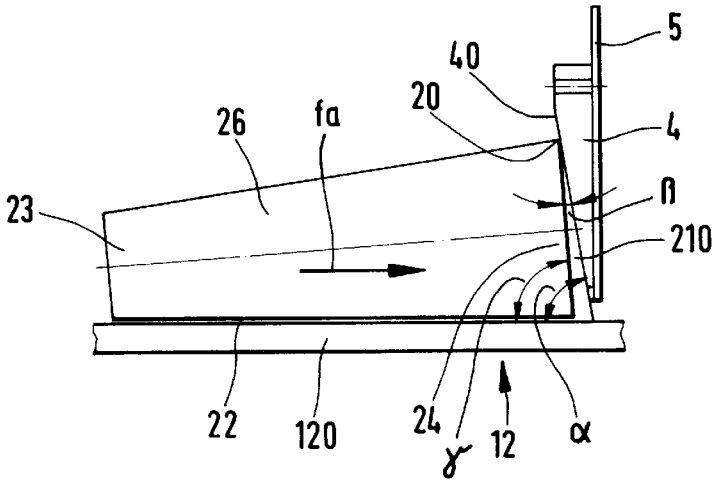
FIG. 2 shows also a schematic front view of a variant of the device shown in FIG. 1 for empty tubes conveyed in the direction opposite to that of the service unit.

The stop 4 is provided with a impact surface 40 which forms an acute angle $\alpha$ with the conveying device 12, 13 as seen in the direction of tube feeding (arrow f) (laterally transposed in FIG. 2). In this manner, the impact surface 40 constitutes a tube pressing device by means of which the empty tube is pressed against the bands 12 and 13 of the tube conveying device. For if the empty tube 2 reaches the impact surface 40 with its upper leading edge 20, this edge 20 constitutes a pivotal point for the empty tube being conveyed by the tube conveying device (bands 12 and 13) which continues to be driven. In its tendency to press with its leading face 21 (FIG. 1) against the impact surface 40, the empty tube 2 is pressed with greater force with its underside 22 lying on the bands 12 and 13 against these bands. Thus a torque or tilting moment is produced in the empty tube 2 which is stopped by the impact surface 40 preventing the trailing end 23 of the empty tube 2 from rearing up on the bands 12 and 13 and from moving to the side. This risk is normally especially great when, in the case of a conical empty tube 2, the trailing end 23 of the empty tube 2 has the greater diameter D.

If a conical empty tube 2 is to be stopped, the center line I of the empty tube 2 is inclined due to the diameter difference between the smaller diameter d at the leading end 24 of the empty tube 2 and the greater diameter D at the trailing end 23, so that the face 21 of the empty tube 2 facing the impact surface 40 forms an acute angle $\beta$ with the impact surface 40 (laterally transposed in FIG. 2).

Figure 3:
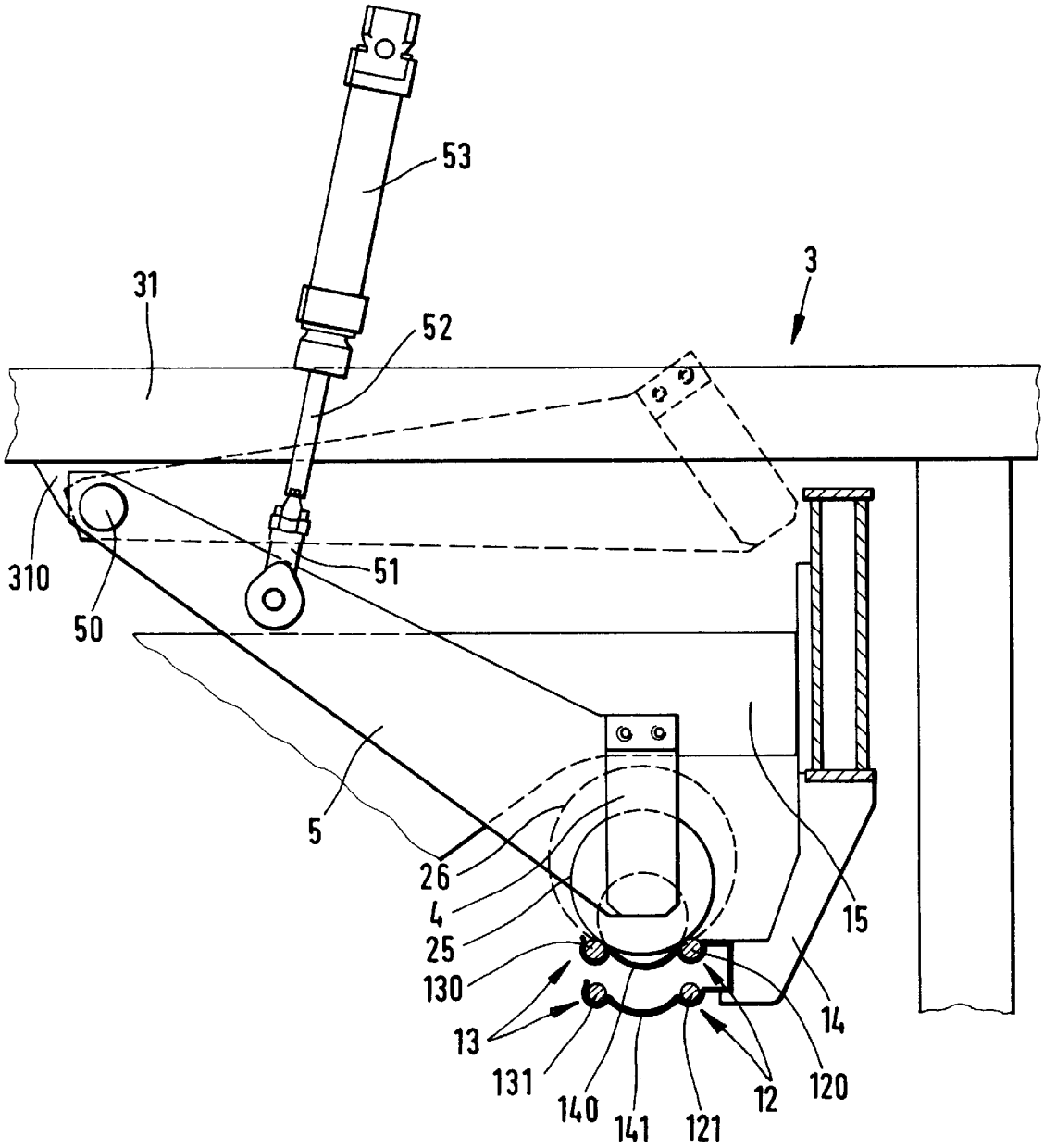
FIG. 3 schematically shows the device shown in FIGS. 1 and 2.

As FIG. 3 shows, tubes of different forms can be used normally on the spinning machine 1. Thus it is possible, for example, to use cylindrical tubes 25 (see FIG. 6 or full line in FIG. 3) or conical tubes 26 (see FIG. 2 or broken line representation in FIG. 3), possibly even with different conicity. So that the stop 4 with its impact surface 40 need not be adjusted anew every time when the tubes 2, 25 or 26 are changed, in order to obtain an acute angle β between the impact surface 40 and the leading face 21 of the empty tube 2 (or 25 or 26) the angle α between the impact surface 40 and the direction of conveying of the tube conveying device (bands 12 and 13) is made in principle smaller than the angle γ between the leading face 21 of the empty tube 2, 25 or 26 and the bands 12 and 13 of the tube conveying device (see FIGS. 2 and 6). In this manner an acute angle β remains in any case between the leading face 21 of the empty tube 2 (or 25 or 26) and the impact surface 40, i.e. independently of the tube form (cylindrical or conical) used, i.e. a torque or tilting moment is generated which presses the empty tube 2 (or 25 or 26) against the bands 12 and 13 of the tube conveying apparatus, and this ensures that the empty tube 2 (or 25 or 26) securely remains on the bands 12 and 13 in spite of a sudden stop.

Figure 6:
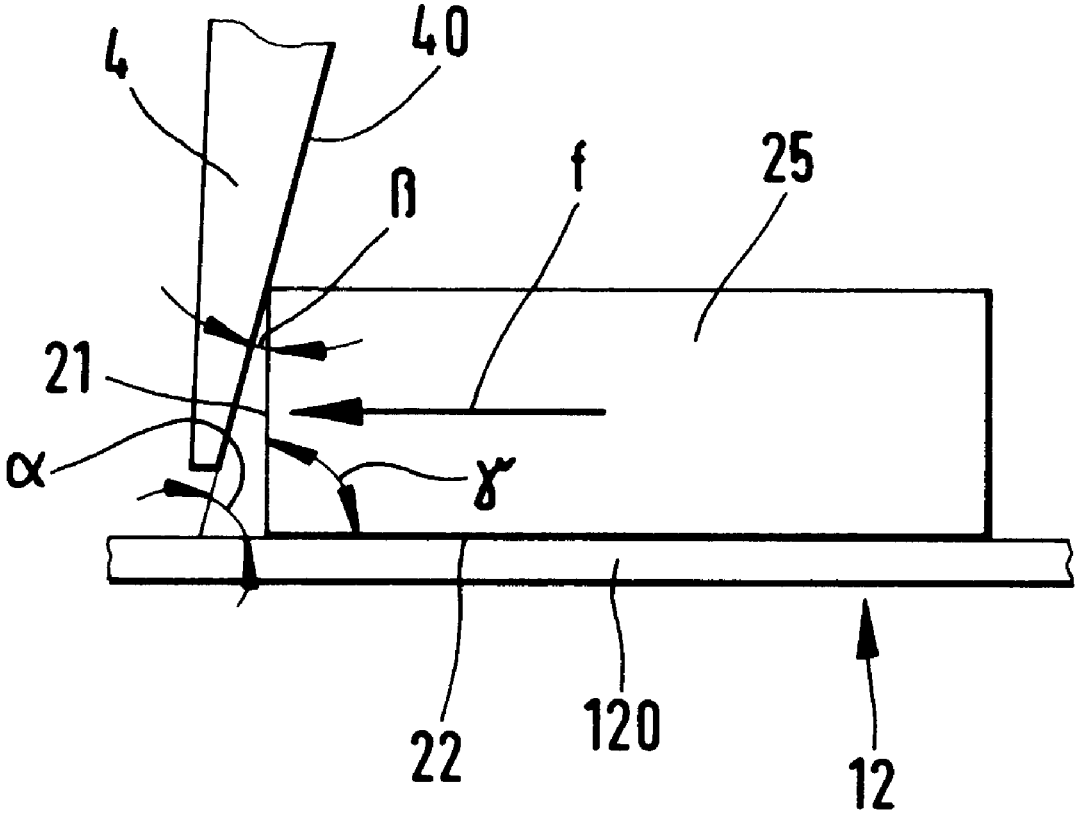
FIG. 6 shows the angular relationships according to the invention in the diagram between the stop, the forward side of the empty tube and the tube conveying device through the example of a cylindrical empty tube.

This also applies to cylindrical tubes 25, as shown in FIG. 6. Here again the angle α between the impact surface 40 and the bands 12 and 13 of the tube conveying device is smaller than the angle γ between the leading face 21 of the empty tube 25 to be stopped and the tube conveying device 12, 13 so that here too the acute angle β required to produce a torque or tilting moment is available.

As long as the bands 12 and 13 move in the direction of the arrow f, the empty tube 2 (or 25 or 26) is pressed by its edge 20 against the impact surface 40 of the stop 4. Due to this force and because the existence of the acute angle β between the impact surface 40 and the leading side of the empty tube 2 (or 25 or 26) the previously mentioned torque or tilting moment is produced, causing the empty tube 2, 25 or 26 to remain securely on the bands 12 and 13 of the tube conveying device. On the other hand, it is often desirable for the empty tube 2, 25 or 26 to be completely at rest for the take-up by the grasping device 30. This is achieved in that the bands 12 and 13 of the conveying device are stopped before the empty tube 2, 25 or 26 is taken up by the grasping device 30.

To stop the bands 12 and 13 once the empty tube 2, 25 or 26 has contacted the stop 4, the empty tube 2, 25 or 26 is monitored. This can be done directly or indirectly by means of a monitoring device 6 (see FIG. 1). For example a light barrier is provided which monitors the forward side 21 or the trailing side of the empty tube 2, 25 or 26 and actuates a signal when the empty tube 2, 25 or 26 has reached the desired position. This signal then causes the stopping of the tube conveying device 12, 13 via the not-shown controls of the spinning machine 1. After a preset time during which the bands 12 and 13 have been stopped with certainty, the drive (not shown) of the grasping device 30 is actuated and takes up the now stopped empty tube 2, 25 or 26 which is lying immobile.

In the example of the embodiment shown, the holder 5 is flexible and for that purpose is made for example of spring steel sheet. FIG. 1 shows a monitoring device 6 made in the form of a scanning device stationary on the service unit 3 for direct monitoring of the position of the empty tube 2, 25 or 26 which scans the position of the holder 5 and actuates a signal for each deviation of the holder 5 or of its stop 4 caused by the impact of the empty tube 2, 25 or 26, i.e. when their lower end which constitutes a switching flag enters the scanning range of the monitoring device 6, in order to stop the tube conveying device 12, 13 or at least to introduce the work of the grasping unit 30.

Elasticity of the holder 5 has furthermore the advantage that the empty tube 2, 25 or 26 is braked progressively, thus attenuating the impact of the empty tube 2, 25 or 26 and thus also contributing in ensuring that the empty tube 2, 25 or 26 remains securely on the bands 12 and 13 of the tube conveying device. The stop 4 is thus made in the form of an attenuating device due to the elastic support by means of the elastic holder 5.

When the holder is designed to be elastic, the torque or tilting moment is triggered when the braking process of the empty tube 2, 25 or 26 begins and continues to be produced until the bands 12 and 13 of the tube conveying device are stopped. When the empty tube 2 impacts the impact surface 40, the angle β is first enlarged due to the elastic nature of the holder 5 and thereby causes an increase of the torque or titling moment. Only when the danger that the empty tube 2, 25 or 26 may leave the tube conveying device is reduced due to forces with lesser effect, e.g. due to the decreasing speed of the tube conveying device with the bands 12 and 13 or other conveying or tube slaving means, does the generated torque or tilting moment also decrease as a function of the above-mentioned deceleration of the tube conveying device.

It is not necessary for the described device to be stopped when the empty tube 2, 25 or 26 has reached its stopping position or be reduced to a lower speed already before this. In certain cases it could be absolutely correct to leave the speed of the tube conveying device unchanged. The greater the speed of the tube conveying device, the greater is the danger that the tubes may fall out of the conveying device when stopping. This means that the invention is especially helpful in rapid conveying devices.

Nor is it necessary that the entire holder 5 be elastic. For example, an elastic element, e.g. in form of a compression spring or two compression springs etc. can be provided on the artriculated bolt 50, allowing which permit a yielding of the holder 5 (within prescribed tolerances) so that the elastically mounted holder 5 may again constitute an attenuating device in this manner, which causes the braking and stopping of the impacting empty tube 2 in an attenuated manner. Here too, the monitoring device 6 can be assigned to the holder 5 and can scan its position, in any conventional (mechanical, optical, inductive, etc.) manner. In this case, it is also possible to dispense with the stop 4, if the holder 5 itself forms an angle with the face of the tube and takes over the function of the stop 4.

To constitute an attenuating device, it is also possible to make the impact surface 40 elastic. Due to the high stress imposed upon the impact surface 40, it is however more advantageous to provide an elastic element between a rigid mounted holder 5 and its stop 4, or to mount the impact surface 40 in the stop 4 elastically.

In another alternate embodiment of the device described above, a piezoelectrical element may be integrated in the holder 5 which emits an appropriate control signal due to the deformation which is caused by an empty tube 2, 25 or 26 impacting the stop 4, either only to actuate the grasping device 30 (see FIG. 1) or to brake or stop the tube conveying device before the grasping device 30 becomes active.

The monitoring device 6 need however not scan the position of the empty tubes 2 directly. Instead, the above-mentioned control can compute the position of the empty tube based on the point in time when the empty tube 2 is laid down on the bands 12 and 13 of the tube conveying device as a function of their speed and the position of the service unit 3 by computer and can actuate the different work steps.

As the above description shows, the described device is not limited to the discussed embodiment. Instead, numerous variants are possible within the framework of the invention. Thus, certain characteristics of the different examples of embodiments can be exchanged among each other or can be used in different combination or be replaced by equivalents. It is for example not absolutely necessary to produce the tilting moment at the leading end 24 of the empty tube 2, 25 or 26 by providing an acute angle β between the impact surface 40 of the stop 4 and the face 21 of the empty tube 2, 25 or 26. Instead of this, a tube pressing device can be provided during the braking and stopping of the empty tube 2, 25 or 26 which is brought to bear upon the trailing end 23 of the empty tube 2, 25 or 26. Such a design of the device for the positioning of the empty tube 2, 25 or 26 in relation to the spinning station 10 of the spinning machine 1 to be supplied with an empty tube 2, 25 or 26 is described below.

Figure 5:
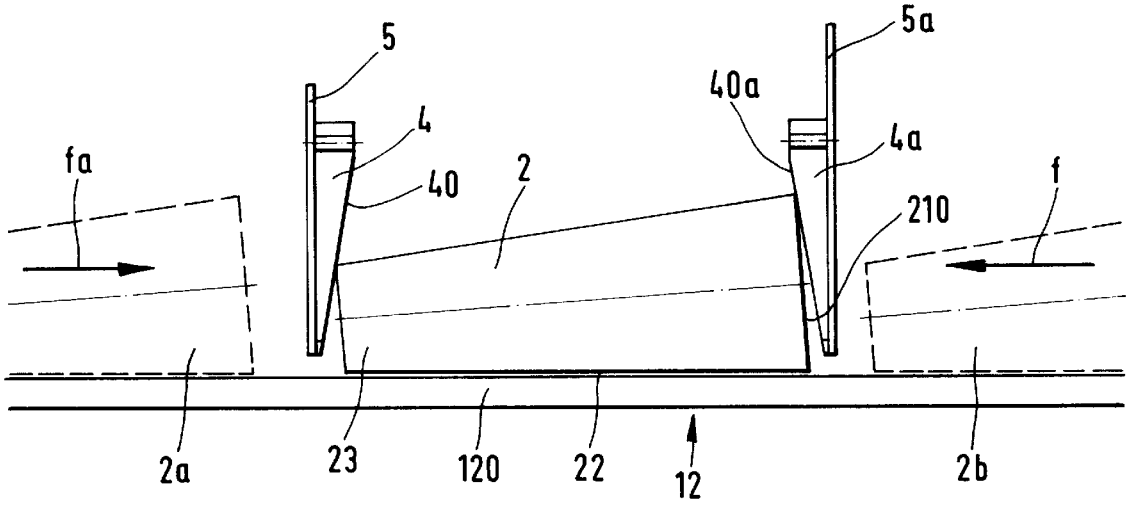
FIG. 5 shows another variant of the device according to the invention with two stops which jointly constitute the tube contact pressure device.

As FIG. 5 shows, a second holder 5*a* with a second stop 4*a* which also has an impact surface 40*a* is provided in addition to the holder 5 with the stop 4 with its impact surface 40, whereby the two impact surfaces 40 and 4*a* are facing each other. Depending on the direction of movement and therefore conveying (arrow f or fa) of the tube conveying device (bands 12 and 13) stop 4 at one time and stop 4*a* at another time are used, while the stop 4*a* or 4 which is not used then remains in its rest position (see FIG. 3).

Since the two stops 4 and 4*a* are essentially placed at a distance from each other equal to the length of the empty tube 2, 25 or 26, the empty tube 2, 25 or 26 always reaches the same stopping position independently of the conveying direction (arrow f or fa). If therefore the empty tube 2*b* is conveyed in the manner described above in the direction of arrow f, the stop 4 is the one to stop the empty tube 2*b*; if the empty tube 2*a* is however conveyed in the direction of arrow fa, it is caught by stop 4*a* and is stopped. Similarly, as described above in FIG. 1 through the example of holder 5, it is also possible to provide a monitoring device 6 (not shown) for the scanning of the position of the holder 5*a* which stop the bands 12 and 13 as a function of a deformation of the holder 5*a*, with normal intercalation of suitable controls (not shown). The stop 4 or 4*a* which is not needed remains, as mentioned, in its holder 5 or 5*a* in its high rest position (FIG. 3).

Through modified control of the device shown in FIG. 5, the stop 4 or 4*a* which is not catching the empty tube 2, 25 or 26 can be used as a (additional) tube pressing device which is brought to bear in this case upon the trailing end of the empty tube 2, 25 or 26 to be stopped. This will be explained through the example of the empty tube 2*a* being delivered from the left (in the direction of arrow fa), it being understood that the course of action of an empty tube 2*b* being supplied from the other side (in direction of arrow f) is analogous to this, taking into consideration this conveying direction f.

At first only the right-side stop 4*a* is brought into its work position as indicated in FIG. 5 while the stop 4 is still in its rest position or ready position in proximity of the empty tube 2*a*. When the empty tube 2*a* reaches its end position, it triggers a stopping impulse for the bands 12 and 13 of the tube conveying device in the described manner with the help of the monitoring device 6. At the same time this impulse causes the stop 4 to be also lowered rapidly now and to contact the trailing end 23 of the empty tube 2*a* with its impact surface 40. Thereby the tilting moment is produced in two manners: once by the acute angle β (not indicated in FIG. 5 for the sake of clarity of the drawing) between the impact surface 40*a* of stop 4*a* and the leading face 210 of the empty tube 2 or 2*a*, secondly by the impact surface 40 of stop 4 which is applied to the trailing end 23 of the empty tube 2 or 2*a*. Thus the impact surfaces 40*a* and 40 constitute together in this case a tube pressing device to produce a torque or tilting moment directed against the tube conveying device 12, 13. It is of secondary importance here that the contact surface 40 interacting with the trailing end 23 of the empty tube 2 is applied only with delay, since the desired torque and tilting moment is already produced by the impact surface 40*a* interacting with the leading end 24 of the empty tube 2.

Another variant of the device described above shall now be described with the help of FIG. 4. The service unit 3 is here again provided with two stops 7 and 7*a* which are however mirror images of the stops 4 and 4*a* of FIG. 5, i.e. their slanted impact surfaces 70 or 70*a* are on the sides of holder 5 and 5*a* away from each other. Here again, a monitoring device 6 (not shown) is assigned to each of the two holders 5 and 5*a*, e.g. piezo-electric elements integrated into the holders 5 and 5*a* which register the impact of an empty tube 2 on one or the other stop 7 or 7*a* due to the deformation resulting from this and which then generates an impulse to stop or brake the bands 12 and 13 of the tube conveying device and to initiate the operation of the grasping device 30. This piezo-electrical element constitutes the above-mentioned monitoring device 6 for the monitoring of the position of the empty tube 2 to be delivered.

When an empty tube called up is to be stopped, both stops 7 and 7*a* are together brought into the shown working position in the conveying path of the empty tube 2 even before the empty tube 2 has reached the service unit 3. If, for instance, the empty tube 2 is brought from the right side in direction of arrow f, it first impacts the impact surface 70*a* of stop 7, i.e. before it reaches its defined stopping position. In doing so it causes a deformation, although slight, of holder 5*a* so that the piezoelectric element integrated into the holder 5*a* triggers an impulse which causes a reduction of the conveying speed of the bands 12 and 13 of the tube conveying device. Due to the elastic nature of holder 5*a*, the empty tube 2 is braked softly. Furthermore, the inclined position of the impact surface 70*a* causes a torque or tilting moment to be exerted upon the empty tube 2 while it is being braked, pressing the empty tube 2 with greater force against the bands 12 and 13 of the tube conveying device. Since the empty tube 2 is still subjected to the driving force of the decelerating bands 12 and 13, it continues to be pressed against the impact surface 70*a* of the stop 7*a*, so that the tilting moment against the two bands 12 and 13 continues to be produced without interruption.

Following a predetermined time, within which the bands 12 and 13 are certain to reach the predetermined reduced speed or, if preferred, following the recording of the predetermined reduced desired speed, as can be recorded by means of a tachometer (not shown) or similar device, the holder 5*a* is lifted up so that the stop 7*a* which it bears is pulled out of the conveying path of the empty tube 2 and releases it. The empty tube 2 can now again follow the bands 12 and 13. However, since these are now only driven at reduced speed, the danger that the empty tube 2 which continues to run up against stop 7 which is as before in its operating position within the conveying path of the tube 2, may carry out uncontrolled movements on the bands 12 and 13 and may drop off from them is negligible. As a rule, it is therefore sufficient to provide a stop with an inclined impact surface 70 on the holder 5, merely on its outside, i.e. on the side of holder 5 which is away from the stopping position of the empty tube 2 (see empty tube 2 shown by broken line). In the shown embodiment of the holder 5 in the form of an elastic element, the latter however gives as the empty tube 2 runs up, so that the angle β which is not shown in FIG. 4 (see FIG. 1) is enlarged, so that a stronger torque or tilting moment holding the empty tube 2 securely on the bands 12 and 13 is produced now for a second time during the stopping of the empty tube 2. At the same time the scanning element assigned to the holder 5, e.g. a piezoelectric element reacting to the deformation of the holder 5, is actuated so that it emits an impulse for the stopping of the bands 12 and 13 of the empty tube 2, 25 or 26 and so that the grasping device 30 is actuated.

In analogous fashion, this also applies to an empty tube 2 which is conveyed to its defined stopping position in the opposite direction, i.e. from left in the direction of the arrow fa. Here, the empty tube 2 first runs up on the outside of the holder 5, i.e. on its side away from the stopping position of the empty tube 2, on the impact surface 70 of stop 7, whereupon the reduction of the conveying speed of the empty tube 2, i.e. the speed of the bands 12 and 13 of the tube conveying device is in turn initiated. Following this, the empty tube 2 is released by pulling up the stop 7, and the empty tube 2 is then conveyed at reduced speed, whereby the holder 5*a* of the stop 7 initiates the stopping of the bands 12 and 13 and the beginning of the operation of the grasping device 30.

Figure 4:
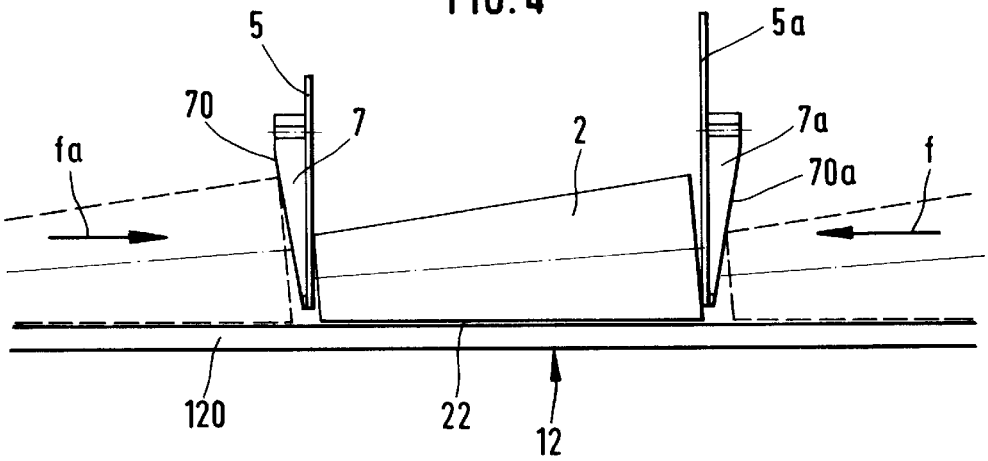
FIG. 4 shows a variant of the device according to the invention in a front view, with two stops.

It is of course also possible to provide an inclined impact surface 40, 70, 40*a*, 70*a* at the free ends of the holders 5 and 5*a*, on either side, i.e. on the side towards and away from the stopping position of the empty tube 2 (i.e. a combination of the arrangements according to FIGS. 4 and 5). In this case, the holder 5*a* supports a stop 7*a* with an outer impact surface 70*a* for pre-stopping the empty tube 2 conveyed in the direction of arrow f, while the impact surface 40 of the stop 4 (see FIG. 5) provokes the final stopping of the empty tube 2 in the defined stopping position so that it may be taken over by the grasping device 30. Furthermore, the holder 5 is provided with an inner stop 7 with an impact surface 70 to pre-stop an empty tube conveyed in the direction of arrow fa, which is finally stopped by the impact surface 70*a* of stop 7*a* after renewed release by stop 7. The function of a device thus modified is as described above, with the difference that in every instance when the empty tube 2 impacts one of the stops 4*a*, 4 or 7, 7*a*, it is not only braked but is in addition subjected to the effect of a high tilting moment by which it is held securely on the bands 12 and 13 or in conveying elements of the tube conveying device made in some other manner.

In the embodiments described above, the tube pressing device by means of which a tilting moment in the direction of the tube conveying device is produced during the speed reduction of the empty tube 2, 25 or 26 from the remaining greater speed of the bands 12 and 13 or similar device of the tube conveying device constitutes an integral part of one or two stops 4, 4*a*, 7 and 7*a*, but the tube conveying device can also be designed in a different manner. Thus for instance, it is possible to bring a tube pressing device to bear upon the empty tube 2, 25 or 26 outside the space required for the grasping device 30, said tube pressing device pressing the trailing end of the empty tube 2, 25 or 26 with greater force against the bands 12 and 13 than the leading end because of its working surface coming to bear upon the empty tube 2, 25 or 26 and because of the placement and inclination of said working surface. The tube pressing device can trigger this function mechanically via a rod system or through a monitoring device 6 located at a suitable location by means of the empty tube 2, 25 or 26 running up on the stop 4, 4*a*, 7 or 7*a*. Thanks to the design and control independent of the holders 5 and 5*a*, such a tube pressing device which is brought to bear upon the trailing end 23 of the empty tube 2, 25 or 26 can be controlled in such a manner that it acts simultaneously or substantially simultaneously with the impact of the empty tube 2, 25 or 26 on the impact surface 40 or 40*a*, this being controlled suitably by this or an additional monitoring device 6.

In particular in view of the different tube forms (cylindrical or conical with different conicities), but also to compensate for tolerances of the interacting parts, it is advantageous if the holder 5 and/or 5*a* can be adjusted along the conveying path of the empty tube 2, 25 or 26. This can be done in different manners, e.g. by adjusting the articulated bolt 50 relative to part 310 of the frame 31 of the service unit 3 (see FIG. 1). Adjustments along a guiding sled can be provided in an alternative manner. This adjustment possibility is especially important when two stops 4 and 4*a* interact in pairs to produce a torque or tilting moment.

The drive of holders 5 and 5*a* or of the holder 5 can also be made in different manners. Thus, instead of a swivel drive, a linear drive is also possible (cylinder or toothed rod drive, etc.) to move the holders 5 and/or 5*a* as the task at hand demands (generation of a tilting moment at the forward and/or rear end of the empty tube 2, 25 or 26 as related to its conveying direction) horizontally or vertically or on an inclined path.

The invention ensures that the tilting moment which results in secure position during braking is always possible to the greatest extent. This is achieved in that the stop for the tubes, whether these are cylindrical or conical, always takes place at the upper end of the face of the tube and thus has the greatest possible leverage in order to tilt the tube. In another embodiment the device or process according to the invention is not located or carried out on a traveling service unit but is located or carried out at a stationary work station. Here too, the advantages of the invention such as described above can be used. Instead of the bands 12 and 13 shown in the example of the embodiment, a different conveying means, e.g. one single broad band on which the tube lies, can of course be used.

FIGS. 7*a* to 7*e* show a drawing with pneumatically actuated stops.

Figure 7D:
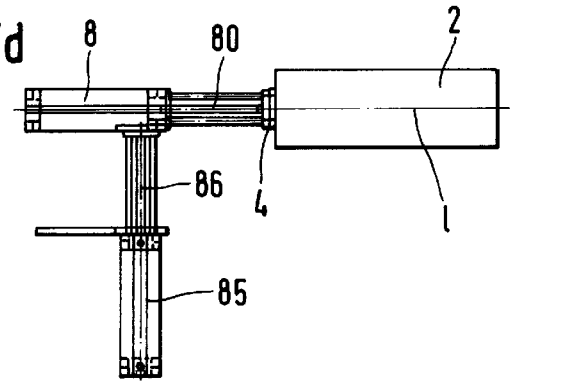
FIGS. 7*a–e* show another embodiment of the invention.
Figure 7E:
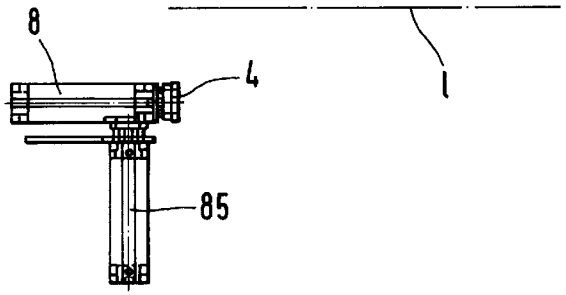
Figure 7A:
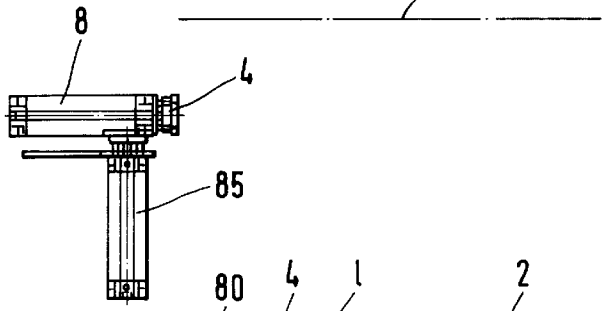

FIG. 7*a* shows the starting position of a stop 4. The stop 4 is located outside the center line I on which the tubes are conveyed. It is attached to a pneumatic cylinder 8. This cylinder 8 is essentially parallel to the center line I. The pneumatic cylinder 8 is attached to the pneumatic cylinder 85. The pneumatic cylinder 85 acts essentially at a right angle to the center line I.

Figure 7B:
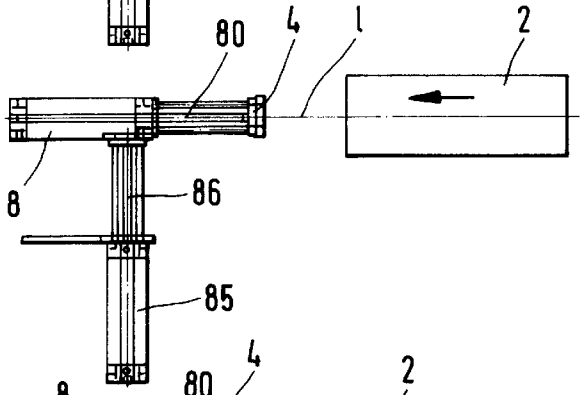
Figure 7C:
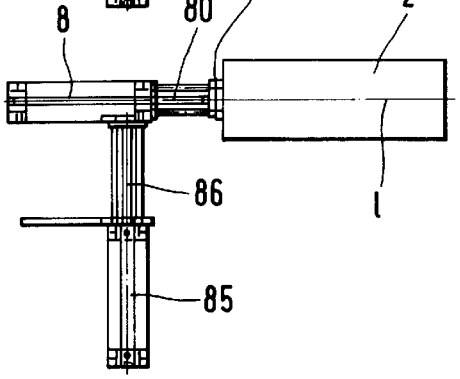

In FIG. 7*b*, the left tube stopper is extended. The drawing shows schematically how the pneumatic cylinder 8 is attached to a rod 86 of the pneumatic cylinder 85. The pneumatic cylinder 8 has in turn the stop 4 on a rod 80 which is also shown in an extended position. The extended position is provoked by pressure applied to the pneumatic cylinders 8 or 85. Once the pneumatic cylinder 8 has reached the stop 4 in this position, the pneumatic cylinder 8 is left without pressure. As a result the approaching tube 2 is subjected to a more attenuated effect as shown in FIG. 7*c* when it is conveyed against stop 4. As a result, the tube 2 is attenuated to such an extent that it remains on the tube conveying band which is not shown. Due to the impulse of the arriving tube 2, the pressure-less pneumatic cylinder is retracted.

According to FIG. 7*d*, the pneumatic cylinder 8 which was at first without pressure is again subjected to pressure, so that rod 80 is extended. The stop 4 which is attached to the rod 80 therefore pushes the tube 2 back into a predetermined position. This predetermined position is suitable for the remaining transfer aggregates on the robot. Upon transfer of the tube, the tube stopper is again moved back into its starting position in which the rod 80 and rod 86 are retracted.

It is advantageous for the sleeve conveying band (not shown) to run until the tube 2 is in its predetermined position as shown in FIG. 7*d*. This ensures that the tube always presses against the stop 4. In order to stop the tube, it may be advantageous to subject the pneumatic cylinder with a lower pressure, e.g. 0.5 bar, while the pneumatic cylinder is subjected to 6 bar of pressure to position the tube. The lower pressure can be selected as a function of the impulse which the tube exerts on the cylinder in such manner that the tube does not fall off the conveyor band.

It should be apparent to those skilled in the art that various modifications and variations can be made in the present invention without departing from the scope and spirit of the invention. It is intended that the present invention cover such modifications and variations as come within the scope of the appended claims and their equivalents.

I claim:

1. A process for positioning empty tubes of a textile machine tube conveying device, comprising conveying said empty tubes alongside a plurality of adjoining spinning stations of said textile machine with said tube conveying device; braking and stopping said tubes in a defined position relative to said spinning stations so that a grasping device can grasp said tubes from said tube conveying device; and exerting a tilting moment to said tubes in a direction substantially parallel to a direction of travel of said tube conveying device as said tubes are braked and stopped.

2. The process as in claim 1, comprising stopping said tubes by moving a stop device into a conveying path of said tubes on said tube conveying device and generating said tilting moment with said stop device.

3. The process as in claim 1, further comprising stopping said conveying device after stopping said tubes, and applying said tilting moment from a beginning of braking of said tubes to stopping of said tube conveying device.

4. The process as in claim 1, comprising applying said tilting moment to a leading edge of said tube in a conveying direction of said tube conveying device.

5. The process as in claim 1, comprising increasing said tilting moment during braking of said tube.

6. A process for positioning empty tubes of a textile machine tube conveying device, comprising conveying said empty tubes alongside a plurality of adjoining spinning stations of said textile machine with said tube conveying device; braking and stopping said tubes in a defined position relative to said spinning stations so that a grasping device can grasp said tubes from said tube conveying device; exerting a tilting moment to said tubes in a direction substantially parallel to a direction of travel of said tube conveying device as said tubes are braked and stopped; and generating a control impulse before said tubes reach said defined position and using said impulse to decelerate said tube conveying device to a reduced conveying speed before said tubes reach said defined position.

7. The process as in claim 6, further comprising braking said tubes before said defined position while applying said tilting moment to said tubes, and releasing said tilting moment after said tube conveying device has reached its reduced conveying speed.

8. The process as in claim 7, further comprising applying said tilting moment again while said tube is stopped at its defined position.

9. A textile machine apparatus for positioning empty tubes carried on a tube conveying device at defined stopped positions relative to a plurality of adjoining spinning stations wherein said tube conveying device conveys said tubes in a conveying path alongside said spinning stations, said apparatus comprising a grasping device having a movable stop positionable into said conveying path, said stop comprising a tube pressing device configured to apply a tilting moment to said tubes in a longitudinal direction of said tube conveying path.

10. The apparatus as in claim 34, wherein said tube pressing device is formed integral with said stop.

11. The apparatus as in claim 9, wherein said stop is adjustable along said conveying path of said tubes.

12. A textile machine apparatus for positioning empty tubes carried on a tube conveying device at defined stopped positions relative to a plurality of adjoining spinning stations wherein said tube conveying device conveys said tubes in a conveying path alongside said spinning stations, said apparatus comprising a grasping device having a movable stop positionable into said conveying path, said stop comprising a side facing said tubes, said side including an impact surface having a shape so as to form a first acute angle with a leading face of said tubes in a direction of travel of said tubes in said conveying path configured to apply a tilting moment to said tubes in a longitudinal direction of said tube conveying path.

13. The apparatus as in claim 12, wherein said impact surface also forms a second acute angle with a top surface of said tube conveying device, said second acute angle being smaller than a third angle between said leading face of said tubes and said top surface of said tube conveying device.

14. A textile machine apparatus for positioning empty tubes carried on a tube conveying device at defined stopped positions relative to a plurality of adjoining spinning stations wherein said tube conveying device conveys said tubes in a conveying path alongside said spinning stations, said apparatus comprising a grasping device having a movable stop positionable into said conveying path, said stop comprising a tube pressing device configured to apply a tilting moment to said tubes in a longitudinal direction of said tube conveying path, wherein said stop further is configured with an attenuating device to attenuate impact of said tubes therewith.

15. The apparatus as in claim 14, wherein said attenuating device comprises an elastic holder for said stop.

16. The apparatus as in claim 14, wherein said attenuating device comprises a pneumatic cylinder.

17. The apparatus as in claim 14, wherein said stop is mounted on said attenuating device.

18. The apparatus as in claim 17, wherein said stop and said attenuating device are movable into said conveying path.

19. A textile machine apparatus for positioning empty tubes carried on a tube conveying device at defined stopped positions relative to a plurality of adjoining spinning stations wherein said tube conveying device conveys said tubes in a conveying path alongside said spinning stations, said apparatus comprising:

a grasping device having a movable stop positionable into said conveying path, said stop comprising a tube pressing device configured to apply a tilting moment to said tubes in a longitudinal direction of said tube conveying path; and a monitoring device configured to monitor position of said tubes on said tube conveying device, said monitoring device generating a control signal to brake or stop said tube conveying device once said tubes have reached a predetermined position.

20. The apparatus as in claim 19, wherein said monitoring device is configured with said stop.

21. The apparatus as in claim 19, wherein said stop is carried by a holder, said monitoring device configured with said holder.

22. A textile machine apparatus for positioning empty tubes carried on a tube conveying device at defined stopped positions relative to a plurality of adjoining spinning stations wherein said tube conveying device conveys said tubes in a conveying path alongside said spinning stations, said apparatus comprising a grasping device having a movable stop positionable into said conveying path, said stop comprising a tube pressing device configured to apply a tilting moment to said tubes in a longitudinal direction of said tube conveying path;

wherein said tube conveying device can travel in either longitudinal direction along said conveying path, said grasping device comprising two said stops at a longitudinal distance from each other generally equal to a length of said tubes, either of said stops movable into a working position depending on a direction of travel of said tubes in said conveying path, each of said stops comprising a said tube pressing device in the form of an impact surface configured to contact and apply a tilting moment to said tubes.

23. The apparatus as in claim 22, wherein either of said stops can be brought to said working position to bear on a trailing edge of said tubes in a direction of travel of said tubes in said conveying path.

24. The apparatus as in claim 22, wherein said impact surfaces of said stops are facing, one of said stops being a leading stop in a direction of travel of said tubes in said conveying path and the other of said stops being a trailing stop, said leading stop movable into said conveying path before said tube has reached said defined stopped position, and said trailing stop movable into said conveying path after said tube has reached said defined stopped position.

25. The apparatus as in claim 22, wherein said impact surfaces of said stops are oppositely facing, wherein one of said stops comes into contact with said tubes first depending on a direction of travel of said tubes in said conveying path, said first contacting stop movable off of said tube after a predetermined time independently of said other stop.

26. The apparatus as in claim 22, wherein each of said stops is mounted in an elastic holder.

27. The apparatus as in claim 26, wherein each of said holders comprises a scanning device to monitor its position.

28. A textile machine, comprising a plurality of adjacently disposed spinning stations a tube conveying device disposed relative to said spinning stations for positioning empty tubes at defined stopped positions relative to said plurality of spinning stations, said tube conveying device conveying said tubes in a conveying path alongside said spinning stations, a grasping device having a movable stop positionable into said conveying path, said stop comprising a tube pressing device configured to apply a tilting moment to said tubes in a longitudinal direction of said conveying path.

29. The textile machine as in claim 28, wherein said tube pressing device is formed integral with said stop.

30. A textile machine, comprising a plurality of adjacently disposed spinning stations, a tube conveying device disposed relative to said spinning stations for positioning empty tubes at defined stopped positions relative to said plurality of spinning stations, said tube conveying device conveying said tubes in a conveying path alongside said spinning stations, a grasping device having a movable stop positionable into said conveying path, said stop comprising a side facing said tubes, said side including an impact surface having a shape so as to form a first acute angle with a leading face of said tubes in a direction of travel of said tubes in said conveying path configured to apply a tilting moment to said tubes in a longitudinal direction of said conveying path.

* * * * *